United States Patent [19]

Menown et al.

[11] Patent Number: 4,761,794

[45] Date of Patent: Aug. 2, 1988

[54] THYRATRON HAVING THERMIONIC CATHODE MATERIAL BETWEEN ANODE AND CONTROL GRID

[75] Inventors: Hugh Menown, Writtle, England; Arthur Maitland, Fife, Scotland

[73] Assignee: English Electric Valve Company Limited, Chelmsford, England

[21] Appl. No.: 810,301

[22] Filed: Dec. 18, 1985

[30] Foreign Application Priority Data

Dec. 22, 1984 [GB] United Kingdom ..... 8432614

[51] Int. Cl.[4] ..... H01J 17/06; H01J 17/54

[52] U.S. Cl. ..... 313/595; 313/310; 313/325

[58] Field of Search ..... 313/595, 597, 599, 600, 313/601, 602, 306, 310, 325

[56] References Cited

U.S. PATENT DOCUMENTS

| | | | |
|---|---|---|---|
| 2,805,353 | 9/1957 | Nienhuis | 313/599 |
| 2,942,136 | 6/1960 | Cook et al. | 313/600 X |
| 3,612,937 | 10/1971 | Smirnov et al. | 313/601 X |

FOREIGN PATENT DOCUMENTS

| | | |
|---|---|---|
| 734586 | 8/1955 | United Kingdom . |
| 788328 | 12/1957 | United Kingdom . |

*Primary Examiner*—Leo H. Boudreau
*Assistant Examiner*—K. Wieder
*Attorney, Agent, or Firm*—Spencer & Frank

[57] ABSTRACT

A thyratron comprises an anode and control grids between which is located a double layer screen grid. Thermionic cathode material is inserted in an aperture in the part of the screen grid furthest from the anode, and in operation this is heated to the required temperature by hot plasma which surrounds it, thus eliminating the need for a cathode heater.

9 Claims, 1 Drawing Sheet

THYRATRON HAVING THERMIONIC CATHODE MATERIAL BETWEEN ANODE AND CONTROL GRID

BACKGROUND OF THE INVENTION

This invention relates to thyratrons. Conventionally, thyratrons have an anode and a cathode, and in the space between them, control grids, and typically also a screen grid. The cathode may be thermionic in which case a cathode heater and its supply must also be provided.

SUMMARY OF THE INVENTION

According to a first aspect of the invention there is provided a thyratron including thermionic cathode material located between an anode and a control grid, arranged such that during operation a main discharge current occurs between the material and the anode. The main discharge current is the entire discharge current or a substantial part of it.

According to a second aspect of the invention there is provided a thyratron including thermionic cathode material located between an anode and a control grid, the said thermionic cathode material having an electron emitting surface which does not directly face the anode.

According to a third aspect of the invention there is provided a thyratron including thermionic cathode material located between an anode and a control grid, the said thermionic cathode material having an electron emitting surface which faces away from the anode.

By employing the invention, the need for a cathode heater may be eliminated, since a cathode material so positioned may be sufficiently heated by surrounding hot plasma for thermionic emission to occur. Also the control grid tends to be shielded from spurios voltage fluctuations in the anode supply which could result in premature triggering of the thyratron.

Preferably, the cathode material is held in position by a screen grid. The cathode material and the screen grid may form an integral structure. Also, it is preferred that the screen grid comprises an inner disc portion and an outer surrounding portion with an aperture between them, the inner disc portion having an aperture in which the cathode material is located, and also preferably the outer surrounding portion is an annulus and is separated from the inner disc portion by three arcuate apertures. Thus the thermal capacity of the cathode material and the inner disc portion may be kept small since heat is not easily conducted to the outer surrounding portion, cooling being largely by radiation and convection effects. Since the thermal capacity is small the cathode material may be brought to the temperature required for thermionic emission to occur in a relatively short time.

Also it is advantageous that the inner disc portion and the outer surrounding portion lie in a first common plane, and the screen grid includes a second disc portion and surrounding portion which are separated by an aperture and lie in a second common plane between the first common plane and the anode, since then the discharge may be enhanced because of the greater surface area available. It is also preferred that the aperture in the first common plane is offset from the aperture in the second common plane.

BRIEF DESCRIPTION OF THE FIGURES

The invention is now further described by way of example with reference to the accompanying drawings, in which.

DESCRIPTION OF THE PREFERRED EMBODIMENT

Figure 1:
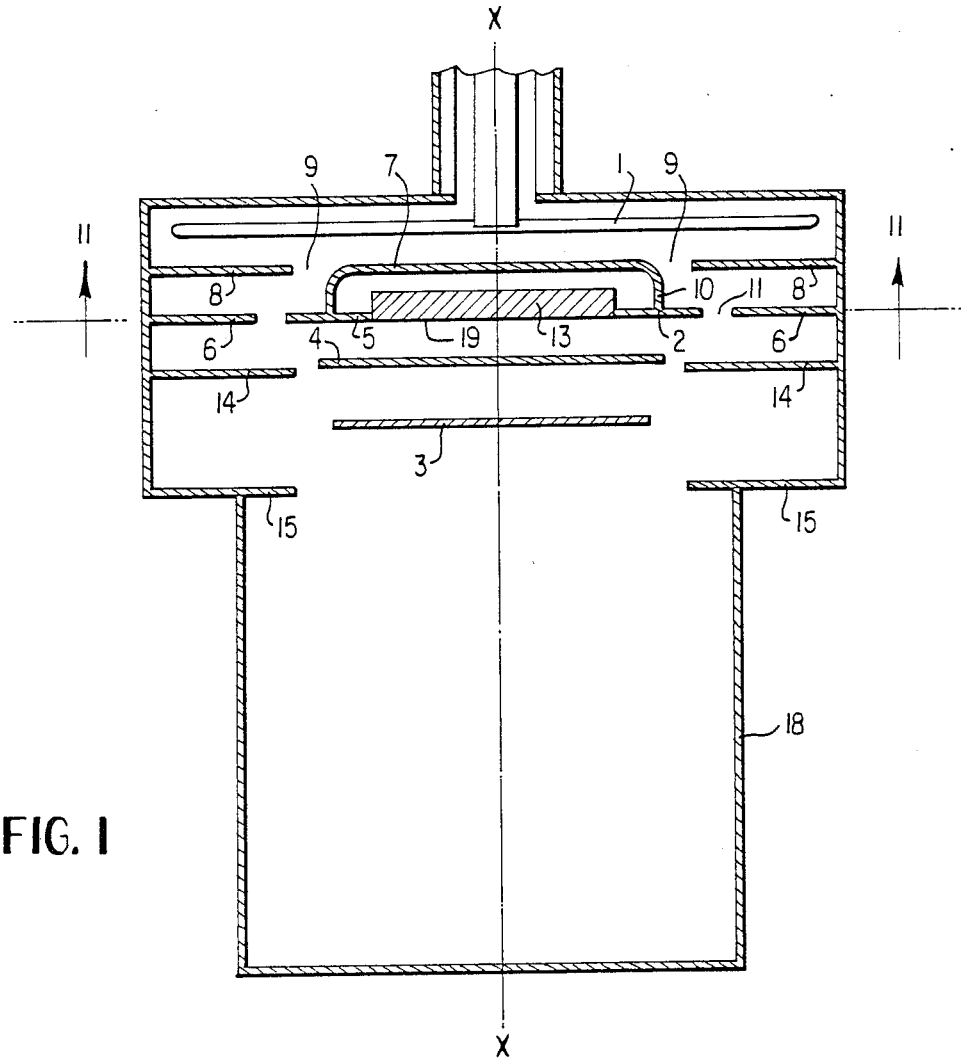
FIG. 1 is a schematic longitudinal section of part of a thyratron inaccordance with the invention.

With reference to FIG. 1, a thyratron comprises an anode 1, screen grid 2, and control grids 3 and 4 within a glass envelope (not shown). The screen grid 2 is of molybdenum and is positioned between the anode 1 and the control grids 3 and 4. It is a two layered structure, having a first central disc portion 5 surrounded by a first annulus portion 6 which lie in a first common plane, and a second central disc portion 7 surrounded by a second annulus portion 8 in a second common plane lying between the first common plane and the anode 1.

Figure 2:
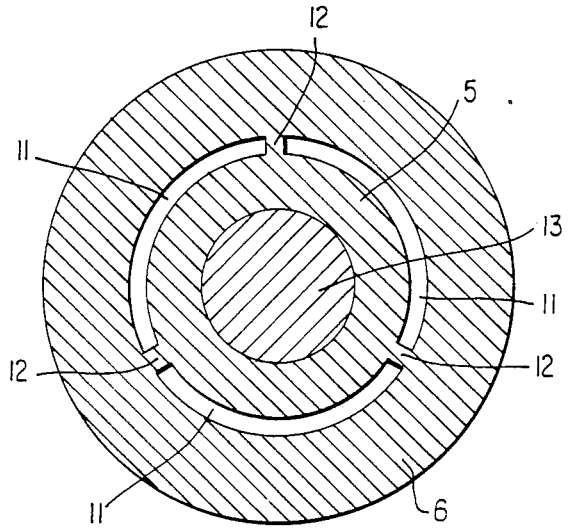
FIG. 2 is a transverse section taken along the line II—II of FIG. 1.

The second disc portion 7 and annulus portion 8 are separated by an annular portion 9, the second disc portion 7 being supported by its rim which is bent to form a cylindrical wall 10, fixed to the surface of the first disc portion 5. The first disc poirtion 5 and the annulus portion 6 are separated by three arcuate apertures 11, as shown in FIG. 2, being connected by three bridges 12.

The annular aperture 9 and the three arcuate apertures 11 are co-axial about the longitudinal axis X—X of the thyratron and are offset from each other, the distance of the aperture 9 from the axis X—X being smaller than that of the arcuate apertures 11 from the axis X—X.

The first central disc portion 5 has a circular aperture co-axial with it. A plug 13 of thermionic cathode material is mounted in the aperture, with its surface flush with the surface of the disc portion 5. The cathode material is sintered tungsten with barium aluminate.

Third and fourth annulus portions 14 and 15 respectively are also enclosed within the glass envelope and are located on the side of the screen grid 2 facing away from the anode 1.

In operation, the scren grid 2 and the third and fourth annulus portions 14 and 15 are maintained at cathode potential and control voltages are applied to the control grids 3 and 4.

A cylindrical structure 18 which corresponds in position to the cathode heat shield of a conventional thyratron is maintained at cathode potential. Initially, breakdown of the gas filling between the control grid 3 and the cylindrical structure 18 is achieved by applying a positive potential to the control grid 3. Then application of a pulse of positive potential to the control grid 4 causes the discharge to penetrate through to the anode 1. The potential difference between the anode 1 and the plug 13 of cathode material causes electrons to be emitted from the surface 19 of the material which faces away from the anode 1 and these contribute to the process.

The cathode material is surrounded by hot plasma since the discharge path extends from the surface 19 of the material, through the apertures 11 and 9 in the screen grid 2 to the anode 1. Thus the material may be heated by the plasma to a sufficiently high temperature for thermionic emission from the surface 19 to occur. The cathode spot for the thermionic emission is located at the rim of the plug 13 adjoining the edge of the first disc portions. The time taken for this required temperature to be reached is relatively short because of the small thermal capacity of the plug 13 and of the two disc portions 5 and 7. Cooling of the plug 13 by thermal conduction to the outer annulus portions 6 and 8 is small since only the bridges 12 provide a path, most of the cooling being due to convection and radiation.

Since the control grids 3 and 4 are shielded from the anode 1 by the screen grid 2 at cathode potential they are less likely to be affected by spurious voltage fluctuations in the anode potential, which could cause unwanted triggering of the thyratron, than is the cause with control grids conventionally positioned in the anode-cathode space.

We claim:

1. A thyratron including: an anode, a control grid, a thermionic cathode material, and a screen grid arranged to hold the cathode material between the anode and the control grid, arranged such that during operation a main discharge current occurs between the material and the anode.

2. A thyratron including: thermionic cathode material, an anode, a control grid, and a screen grid arranged to hold the thermionic cathode material between the anode and the control grid, the thermionic cathode material having an electron emitting surface which does not directly face the anode and being arranged such that during operation a main discharge current occurs between the material and the anode.

3. A thyratron including: thermionic cathode material, an anode, a control grid, and a screen grid arranged to hold the thermionic cathode material between the anode and the control grid, the thermionic cathode material having an electron emitting surface which faces away from the anode and being arranged such that during operation a main discharge current occurs between the material and the anode.

4. A thyratron as claimed in claim 1 and wherein said screen grid comprises an inner disc portion and an outer surrounding portion, there being an aperture between then and the inner disc portion having an aperture therein in which said said cathode material is located.

5. A thyratron as claimed in claim 4 and wherein said outer surrounding portion is an annulus and is separated from said inner disc portion by three arcuate apertures.

6. A thyratron as claimed in claim 4 and wherein said inner disc portion and said outer surrounding portion are positioned in a first common plane and said screen grid includes a second disc portion and a second surrounding portion which are separated by an aperture and are positioned in a second common plane located between the first common plane and the said anode.

7. A thyratron as claimed in claim 6 and wherein the aperture in the first common plane is offset from the aperture in the second common plane.

8. A thyratron as claimed in claim 1 and wherein said screen grid is of molybdenum.

9. A thyratron as claimed in claim 1 and wherein said cathode material comprises sintered tungsten and barium aluminate.

* * * * *